US007326847B1

(12) United States Patent
Hsieh

(10) Patent No.: US 7,326,847 B1
(45) Date of Patent: Feb. 5, 2008

(54) METHODS AND SYSTEMS FOR DYNAMIC CHANNEL ALLOCATION

(75) Inventor: Yu-cheng Hsieh, Renwu Township, Kaohsiung County (TW)

(73) Assignee: Mediatek Incorporation, Hsin-Chu (TW)

( * ) Notice: Subject to any disclaimer, the term of this patent is extended or adjusted under 35 U.S.C. 154(b) by 281 days.

(21) Appl. No.: 11/001,655

(22) Filed: Nov. 30, 2004

(51) Int. Cl.
*G10H 1/22* (2006.01)
*G10H 7/00* (2006.01)

(52) U.S. Cl. ..... 84/618; 84/609; 84/645

(58) Field of Classification Search ..... 84/618, 84/609, 645
See application file for complete search history.

(56) References Cited

U.S. PATENT DOCUMENTS 5,042,355 A * 8/1991 Kozuki ..... 84/618
5,095,800 A * 3/1992 Matsuda ..... 84/618
5,315,057 A * 5/1994 Land et al. ..... 84/601
5,380,949 A * 1/1995 Matsuda ..... 84/618
5,488,196 A * 1/1996 Zimmerman et al. ..... 84/612
5,744,740 A * 4/1998 Mizuno ..... 84/615
5,852,251 A * 12/1998 Su et al. ..... 84/645
5,902,947 A * 5/1999 Burton et al. ..... 84/477 R
5,902,949 A * 5/1999 Mohrbacher ..... 84/609
5,959,232 A * 9/1999 Wakuda ..... 84/618
6,091,012 A * 7/2000 Takahashi ..... 84/626
6,198,035 B1 * 3/2001 Saito et al. ..... 84/617
6,226,697 B1 * 5/2001 Tokuhiro ..... 710/36
6,414,232 B2 * 7/2002 Ikeya ..... 84/604
6,423,893 B1 * 7/2002 Sung et al. ..... 84/645
6,670,535 B2 * 12/2003 Anderson et al. ..... 84/443
6,806,412 B2 * 10/2004 Fay ..... 84/645
7,005,572 B2 * 2/2006 Fay ..... 84/645
7,012,185 B2 * 3/2006 Holm et al. ..... 84/645
7,045,700 B2 * 5/2006 Hamalainen et al. ..... 84/645
7,045,752 B2 * 5/2006 Posamentier et al. ..... 250/205
2001/0045455 A1 * 11/2001 Kreuter et al. ..... 235/381
2002/0124715 A1 * 9/2002 Fay ..... 84/645
2002/0170415 A1 * 11/2002 Hruska et al. ..... 84/609
2002/0189430 A1 * 12/2002 Mukojima ..... 84/615
2003/0015084 A1 * 1/2003 Bengtson ..... 84/622
2004/0060422 A1 * 4/2004 Anderson et al. ..... 84/443
2005/0056143 A1 * 3/2005 Fay ..... 84/645
2005/0075882 A1 * 4/2005 Fay et al. ..... 704/270
2005/0076770 A1 * 4/2005 Stone et al. ..... 84/609
2005/0091065 A1 * 4/2005 Fay et al. ..... 704/278

* cited by examiner

*Primary Examiner*—Lincoln Donovan
*Assistant Examiner*—Christina Russell
(74) *Attorney, Agent, or Firm*—Thomas, Kayden, Horstemeyer & Risley

(57) ABSTRACT

Methods and systems of dynamic channel allocation. The provided methods and systems can be employed in a music synthesis system comprising a synthesizer. Audio instructions from sources, such as MIDI players, are received. Available channels provided by the synthesizer are sought for channel allocation. The searched available channels are assigned to the audio instructions for music synthesis.

14 Claims, 6 Drawing Sheets

METHODS AND SYSTEMS FOR DYNAMIC CHANNEL ALLOCATION

BACKGROUND

The invention relates to channel allocation methods for music synthesis systems, and in particular to dynamic channel allocation methods.

Music synthesis systems can be employed in various devices or systems, such as mobile phones, computers, or game machines, for music synthesis.

FIG. 1 is a diagram of a conventional method of channel allocation. A musical instrument digital interface player (MIDI player) 100 is shown on the left of FIG. 1 as a source for sending audio instructions. Music instrument digital interface (MIDI) is a protocol designed for recording and playing back music on digital synthesizers. Rather than representing musical sound directly, MIDI transmits information about how music is produced.

MIDI player 100 utilizes channels. Audio instructions from MIDI player 100 correspond to channels thereof. A music synthesizer 102 is shown on the right of FIG. 1. When music synthesizer 102 receives audio instructions from MIDI player 100, the audio instructions are mapped to the corresponding channels in the music synthesizer 102. For example, if an audio instruction 108 comes from channel-1 (104) of MIDI player 100, the audio instruction 108 is sent to channel-1 (106) in the synthesizer 102. An audio instruction 110 from channel-3 (112) is assigned to channel-3 (114) of the synthesizer 102. As mentioned, the music synthesizer 102 performs music synthesis successfully for one audio instruction source 100.

Here, channel-10 in music synthesizer 102 is a specific channel for percussion audio instructions. If audio instructions are percussion type, the allocated channel in MIDI player 100 is channel-10 according to MIDI channel specifications. Thus, percussion audio instructions are always assigned to channel-10 in the music synthesizer 102 according to conventional allocation methods. All audio instructions sent to channel-10 in the music synthesizer 102 are interpreted as percussion audio instructions without pitch.

FIG. 2 is a diagram of an embodiment of channel allocation for multiple MIDI players. Two MIDI players 200, 202 are shown on the left of FIG. 2 as audio instruction sources. A music synthesizer 204 is shown on the right of FIG. 2. If MIDI player-1 (200) and MIDI player-2 (202) send audio instructions 212, 214 from channel-1 (206, 208) to the music synthesizer 204, channel-1 (210) in the music synthesizer 204 cannot be allocated to multiple sources, causing channel allocation failure. Additionally, the music synthesizer 204 has only one channel-10 for percussion audio instructions. Percussion audio instructions from two different sources cannot be allocated properly in the music synthesizer 204. Thus, channel allocation methods of a music synthesizer for multiple sources are desirable.

SUMMARY

In an exemplary embodiment of dynamic channel allocation method for a music synthesis system with a synthesizer, by which audio instructions from sources are received. The sources can be players using MIDI or other formats. Available channels provided by the synthesizer are sought. Located available channels are assigned dynamically to the received audio instructions. Each audio instruction corresponds to a channel. If received audio instructions are percussion type, any available channel can be assigned as a percussion channel without channel limitation.

DESCRIPTION OF THE DRAWINGS

The present invention can be more fully understood by reading the subsequent detailed description and examples with references made to the accompanying drawings, wherein.

DESCRIPTION

Methods of dynamic channel allocation for a music synthesis system are provided. The music synthesis system comprises a synthesizer with channels for music synthesis.

Figure 1:
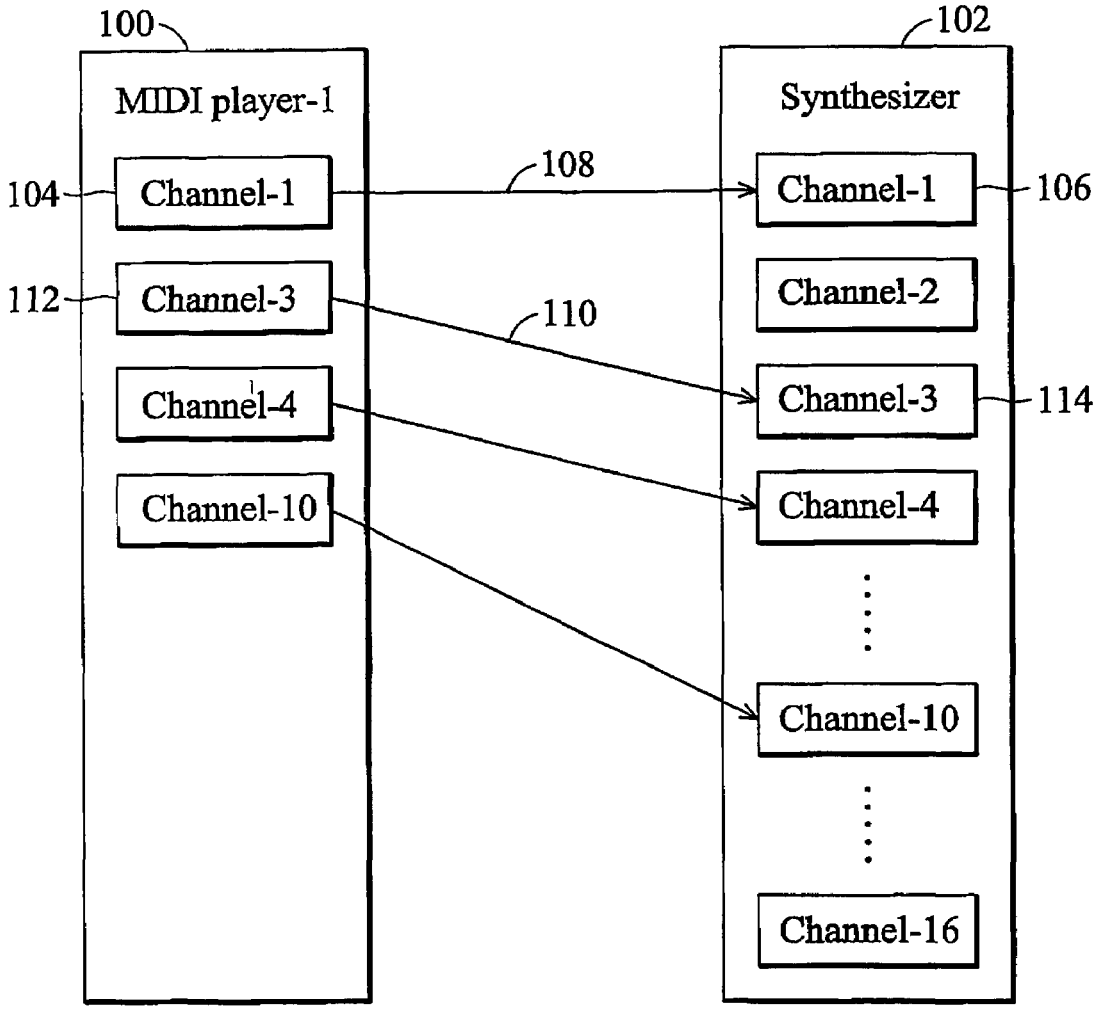
FIG. 1 (RELATED ART)
FIG. 1 is a diagram of a conventional method of channel allocation.
Figure 2:
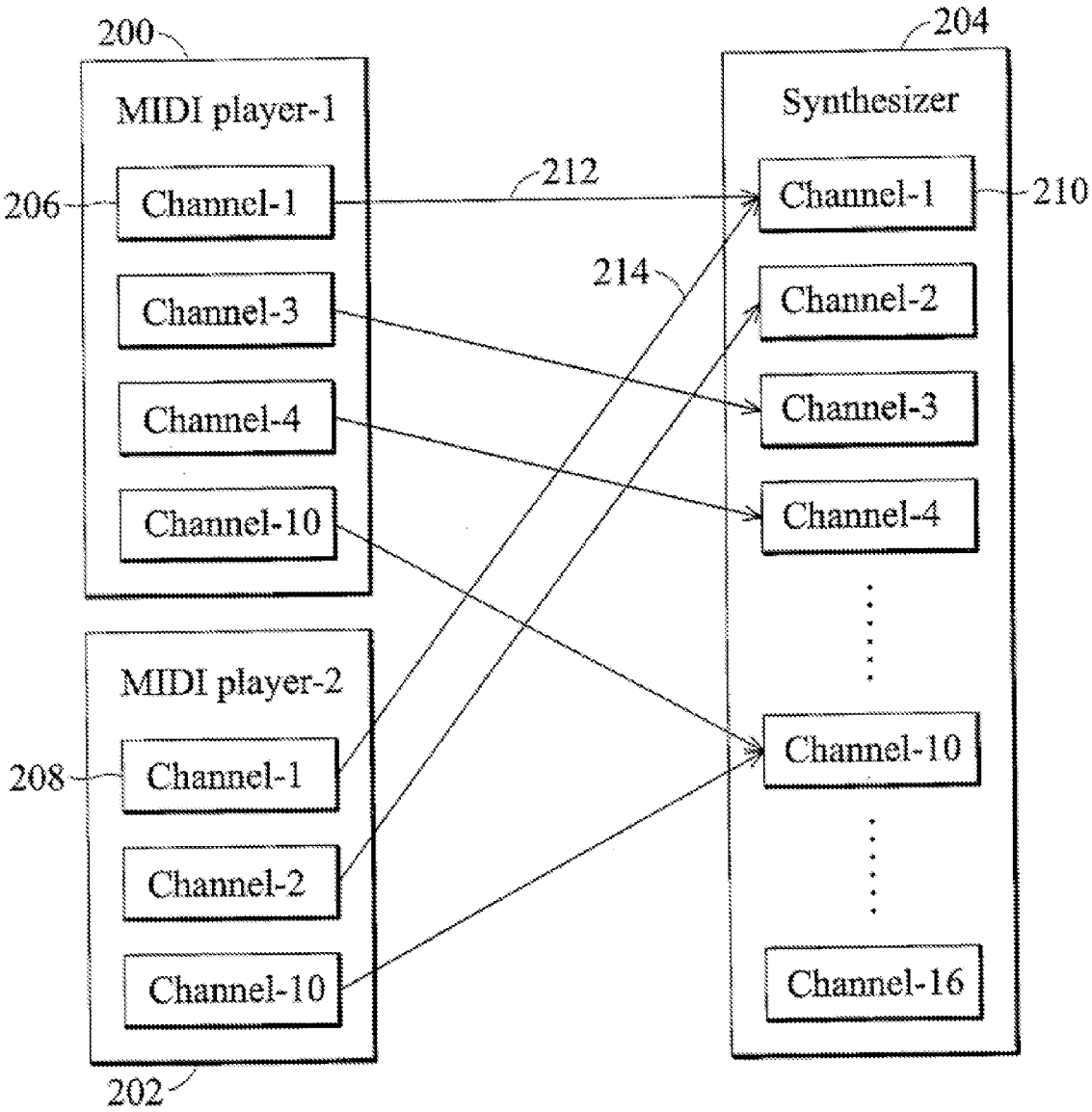
FIG. 2 (RELATED ART)
FIG. 2 is a diagram of an embodiment of a conventional method of channel allocation for multiple MIDI players.
Figure 3:
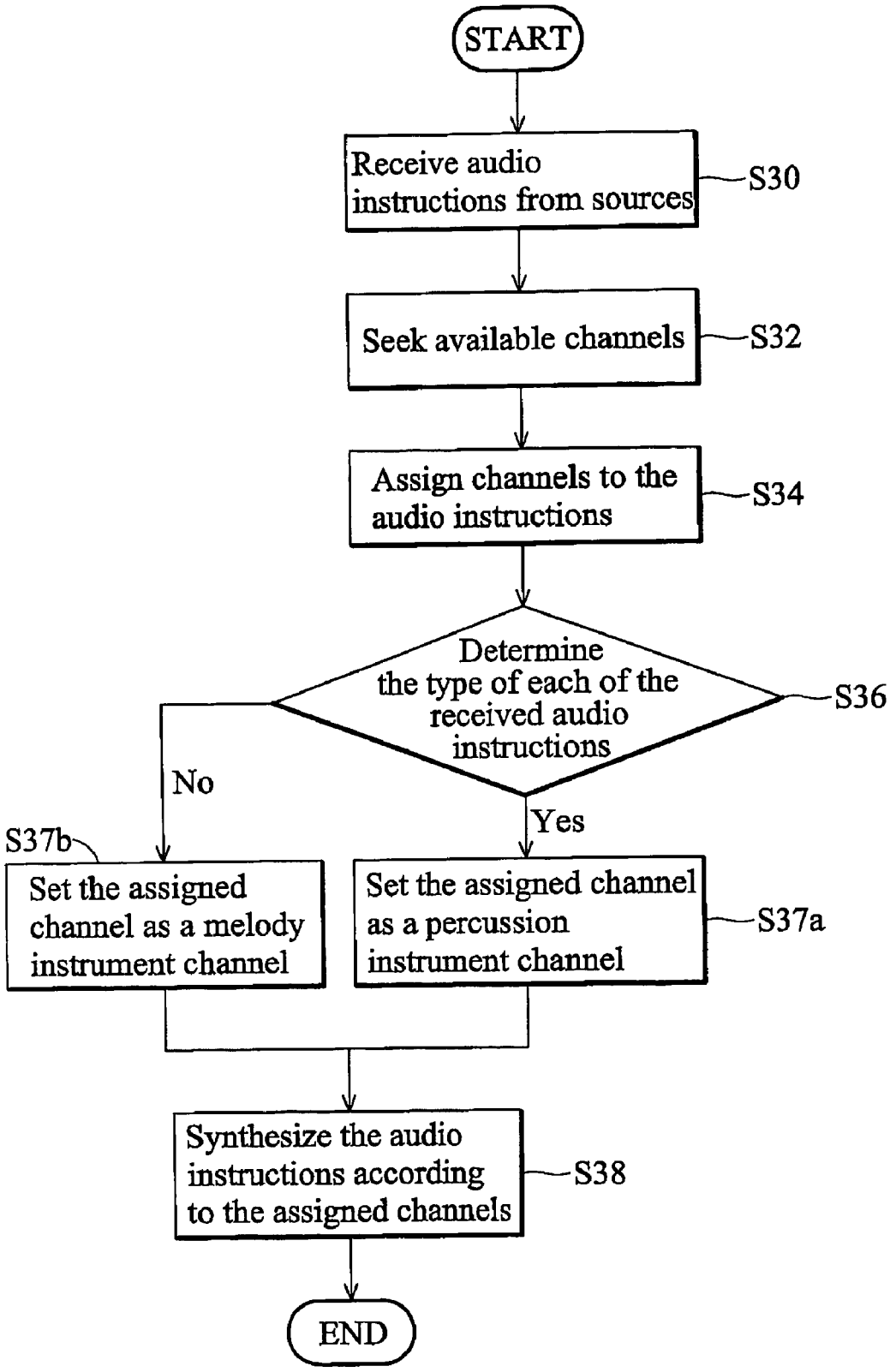
FIG. 3 is a flowchart of an embodiment of a dynamic channel allocation method for a music synthesis system.

FIG. 3 is a flowchart of an embodiment of a dynamic channel allocation method for a music synthesis system. Audio instructions from sources, such as MIDI players, are received (step S30). Next, available channels provided by the synthesizer are sought (step S32). Located channels are assigned to the audio instructions (step S34). Each of the audio instructions corresponds to a channel. Then, the type of each of the audio instructions is determined (Step 36). If the audio instruction is a percussion type audio instruction, the channel assigned to the percussion type audio instruction is set as a percussion instrument channel (Step 37*a*). If the audio instruction is a melody type audio instruction, the channel assigned to the melody type audio instruction is set as a melody instrument channel (Step 37*b*). The synthesizer then synthesizes the audio instructions (step S38).

The number of available channels depends on the system resource. If the number of available channels is designed as fixed, the available channels are allocated before seeking. In step S34, if the number of available channels is floatable, the seeking of available channels comprises unused memory allocation. Thus, channels can be allocated dynamically. The available channels can be managed through some data structure, such as linking list, for better performance.

Here, any available channel can be dynamically set as a percussion instrument channel to be assigned to a percussion type audio instruction, while conventional allocation methods can only assign a specific channel, for example, channel-10, to the percussion type audio instruction. In step S30, the sources may have different priorities for music synthesis. For example, MIDI player-1 may be a main player and MIDI player-2 may be a secondary player. Thus, the received audio instructions can be divided according to the priorities of the sources therefrom. Channel assignation is executed according to predetermined priorities of the audio instructions. Namely, the audio instructions from the MIDI player-1 have higher priorities than the audio instructions from the MIDI player-2 to be assigned to the located channels.

Figure 4:
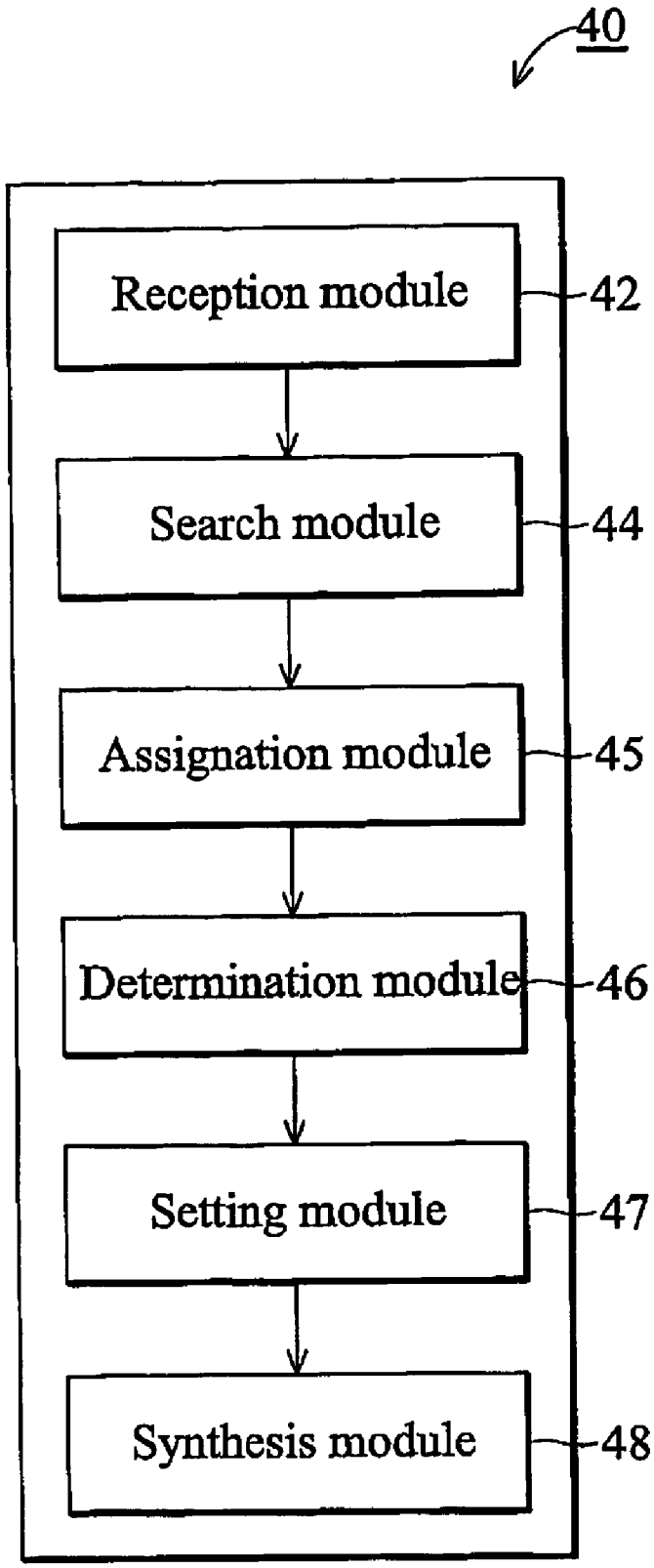
FIG. 4 is a diagram of an embodiment of a music synthesizer using dynamic channel allocation.

FIG. 4 is a diagram of an embodiment of a music synthesizer using dynamic channel allocation. The music synthesizer 40 comprises a reception module 42, a search module 44, an assignation module 45, a determination module 46, a setting module 47, and a synthesis module 48.

The reception module 42 receives audio instructions from sources, such as MIDI players. The search module 44 is coupled to the reception module 42. The search module 44 seeks available channels provided by the music synthesizer 40. The assignation module 45, coupled to the search module 44, assigns channels to the audio instructions, each of which corresponds to a channel. The determination module 46 determines the type of each of the received audio instructions. Here, again, the number of available channels depends on the system resource. If the number of available channels is fixed, the search module 44 allocates unused memory as available channels before seeking. The available channels can be managed through some data structure, such as linking lists. For example, if the reception module 42 receives audio instructions from sources, the search module 44 allocates unused memory as available channels according to the system resource. The assignation module 45 then assigns the allocated available channels to the audio instructions.

If the audio instruction is a percussion type audio instruction, the setting module 47 sets the channel assigned to the percussion type audio instruction as a percussion instrument channel. If the audio instruction is a melody type audio instruction, the setting module 47 sets the channel assigned to the melody type audio instruction as a melody instrument channel. The synthesis module 48 synthesizes the audio instructions.

Specifically, sources may have different priorities. Thus, the channels are located and assigned the audio instructions according to the priorities. In some embodiment, audio instructions from one specific MIDI player may have higher priority than other audio instructions. The assignation module 46 executes channel assignation according to predetermined priorities of the audio instructions.

In some embodiment, the priorities of the audio instructions are determined by the order of the audio instructions received by the music synthesizer 40.

Figure 5:
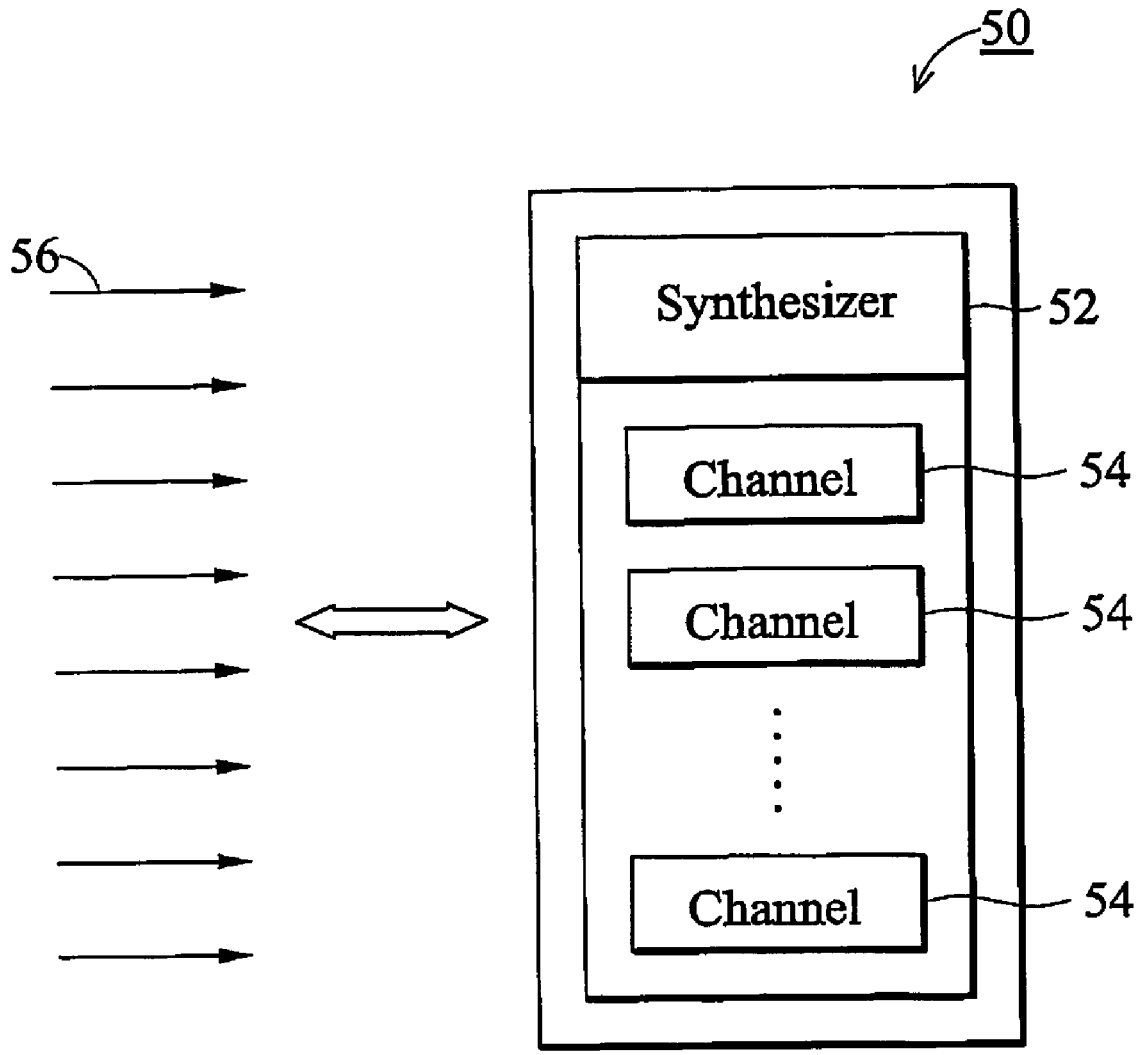
FIG. 5 is a diagram of an embodiment of a music synthesis system.

FIG. 5 is a diagram of an embodiment of a music synthesis system. The music synthesis system 50 includes a synthesizer 52.

The synthesizer 52 allocates audio instructions 56 to channels 54 thereof. Each audio instruction corresponds to a channel. The synthesizer 52 also determines the type of each of the received audio instructions. If the audio instruction is a percussion type audio instruction, the synthesizer 52 sets the channel assigned to the percussion type audio instruction as a percussion instrument channel. If the audio instruction is a melody type audio instruction, the synthesizer 52 sets the channel assigned to the melody type audio instruction as a melody instrument channel. In some embodiment, the audio instructions may have priorities based on sources thereof. In some embodiment, the audio instructions may have priorities based on the order of being received by the synthesizer 52. If the audio instructions have priorities, the synthesizer 52 executes allocation according to predetermined priorities of the audio instructions. In one embodiment, the sources can be MIDI players.

Figure 6:
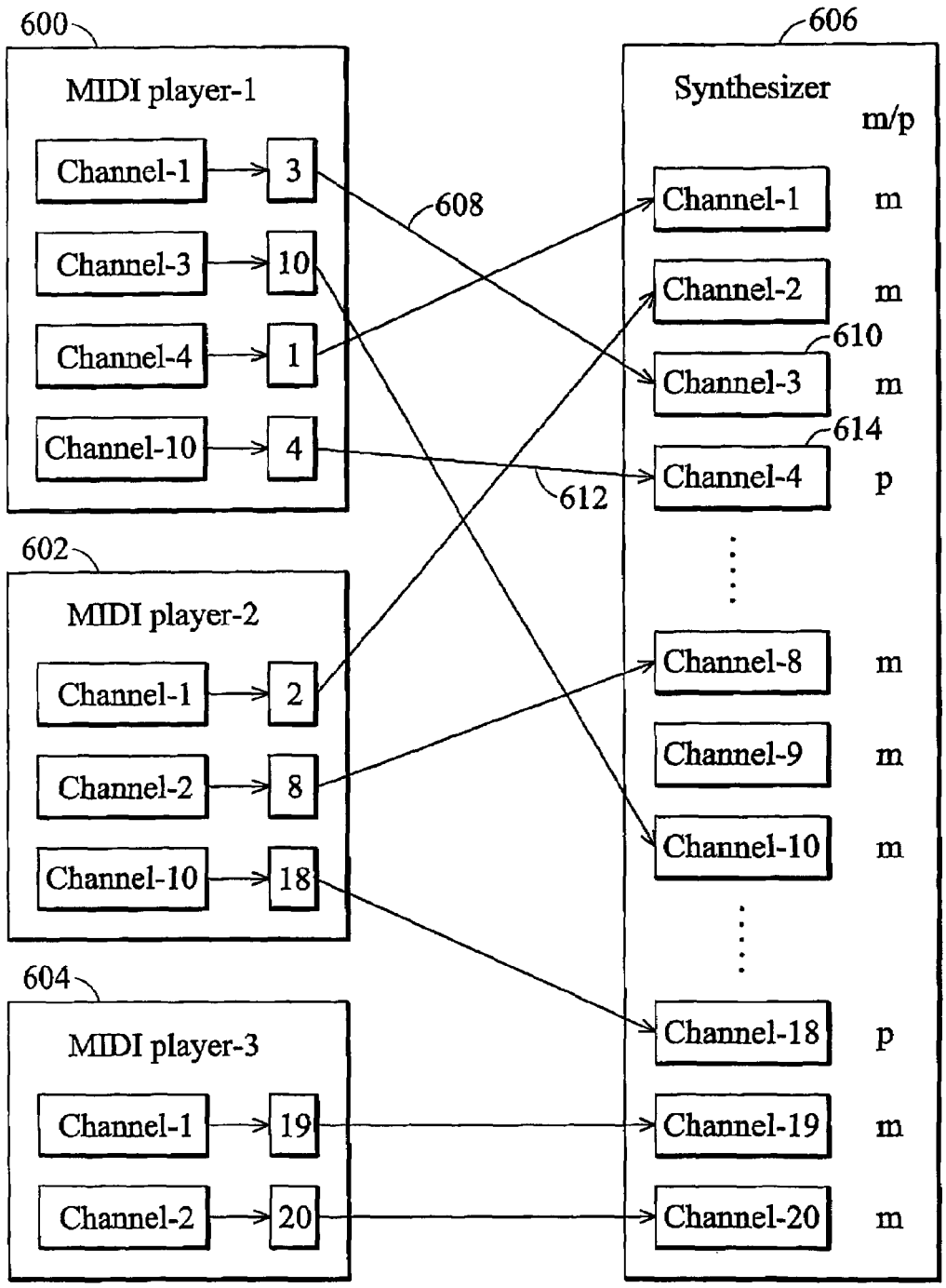
FIG. 6 is a diagram of an embodiment of a dynamic channel allocation method for multiple MIDI players.

FIG. 6 is a diagram of an embodiment of a dynamic channel allocation method for multiple MIDI players. MIDI players-1, 2, and 3 (600, 602, 604) are shown on the left of FIG. 6 as audio instruction sources. In this embodiment, the sources are regarded as the same priority, and the priorities of the audio instructions are based on the order of being received by the synthesizer 52. MIDI player-1, 2, and 3 (600, 602, 604) utilizes channels respectively. A music synthesizer 606 is shown on the right of FIG. 6. When the music synthesizer 606 receives audio instructions from MIDI players 600, 602, and 604, available channels are searched. The available channels are then dynamically allocated to the audio instructions.

For example, an audio instruction 608 comes from channel-1 of MIDI player-1 (600). The music synthesizer 606 receives the audio instruction 608 and seeks the available channel. Channel-3 (610) is sought as an available channel. Thus, the audio instruction 608 is assigned to channel-3 (610) of the synthesizer 606. Then, it is determined that the audio instruction 608 is a melody type audio instruction, and the channel assigned to the audio instruction 608 is set as a melody instrument channel.

As another example, an audio instruction 612 comes from channel-10 of MIDI player-1 (600). The music synthesizer 606 then seeks available channel. Channel-4 (614) is sought as an available channel. Thus, the audio instruction 612 is assigned to channel-4 (614) of the synthesizer 606. Then, it is determined that the audio instruction 612 is a percussion type audio instruction because the audio instruction 612 comes from channel-10 of MIDI player-1 (600), and the channel assigned to the audio instruction 612 is set as a percussion instrument channel.

In some embodiment, the synthesizer 606 has 20 channels to be assigned to 20 audio instructions. The audio instructions coming from channel-1, 3, 4, 10 of MIDI player-1 (600), channel-1, 2, 10 of MIDI player-2 (602), and channel-1, 2 of MIDI player-3 (604) are received by the music synthesizer 606. The music synthesizer 606 then seeks and assigns the 9 available channel-1, 2, 3, 4, 8, 10, 18, 19, 20 to the received audio instructions. Then, the type of each of the received audio instructions is determined, and the channel-4, 18 of the music synthesizer 606 assigned to the percussion type audio instructions are set as percussion instrument channels while the channel-1, 2, 3, 8, 10, 19, 20 of the music synthesizer 606 are set as melody instrument channels.

Compared to conventional methods, the present invention allocates channels more flexibly and dynamically, because percussion type audio instructions are only assigned to channel-10 in convention methods. The number of channels depends on the resources of a synthesizer. Moreover, if a synthesizer cannot find available channels thereof, rejection notification may be sent to MIDI players.

Thus, methods and systems of dynamic channel allocation for a music synthesizer may potentially resolve the inconvenience of conventional channel allocation methods. The disclosed methods are particularly useful for a music synthesizer in an embedded system.

Methods of the present invention, or certain aspects or portions of embodiments thereof, may take the form of program code (i.e., instructions) embodied in media, such as floppy diskettes, CD-ROMS, hard drives, firmware, or any other machine-readable storage medium, wherein, when the program code is loaded into and executed by a machine, such as a computer, the machine becomes an apparatus for practicing and embodiment of the invention. The methods and apparatus of the present invention may also be embodied in the form of program code transmitted over some transmission medium, such as electrical wiring or cabling, through fiber optics, or via any other form of transmission, wherein, when the program code is received and loaded into and executed by a machine, such as a computer, the machine becomes an apparatus for practicing and embodiment of the invention. When implemented on a general-purpose processor, the program code combines with the processor to provide a unique apparatus that operates analogously to specific logic circuits.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A dynamic channel allocation method for a music synthesis system, wherein the system comprises a synthesizer, the method comprising:

receiving at least one audio instruction from at least one source, wherein each audio instruction has an audio instruction ID;

seeking available channels provided by the synthesizer, wherein each channel has an channel ID;

assigning channels to the audio instructions, wherein each audio instruction corresponds to a channel, and the audio instruction ID and the assigned channel ID have no intrinsic correspondence, wherein the channels are assigned to the audio instructions dynamically;

determining the type of each of the received audio instructions; and setting the assigned channel as a percussion instrument channel if the received audio instruction is determined to be a percussion type audio instruction and setting the assigned channel as a melody instrument channel if the received audio instruction is a melody type audio instruction.

2. The dynamic channel allocation method for a music synthesis system as claimed in claim 1, wherein the method further comprises the step of synthesizing the audio instructions according to the assigned channels by the synthesizer.

3. The dynamic channel allocation method for a music synthesis system as claimed in claim 1, wherein the source is a musical instrument digital interface player (MIDI player).

4. The dynamic channel allocation method for a music synthesis system as claimed in claim 1, wherein the assignation is executed according to predetermined priority of the audio instruction.

5. The dynamic channel allocation method for a music synthesis system as claimed in claim 1, wherein the step of seeking available channels further comprises the operation of allocating unused memory space to be an available channel.

6. A music synthesizer of dynamic channel allocation, comprising:

a reception module, receiving at least one audio instruction from at least one source, wherein each audio instruction has an audio instruction ID;

a search module, coupled to the reception module, seeking available channels provided by the music synthesizer, wherein each channel has an channel ID; and an assignation module, coupled to the search module, assigning channels to the audio instructions, wherein each audio instruction corresponds to a channel, and the audio instruction ID and the assigned channel ID have no intrinsic correspondence, wherein the channels are assigned to the audio instructions dynamically;

a determination module, coupled to the assignation module, for determining the type of each of the received audio instructions; and a setting module, coupled to the determination module, for setting the channel assigned to the percussion type audio instruction as a percussion instrument channel and the channel assigned to the melody type audio instruction as a melody instrument channel.

7. The music synthesizer of dynamic channel allocation as claimed in claim 6, wherein the music synthesizer further comprises a synthesis module, coupled to the assignation module, for synthesizing the audio instructions according to the assigned channels.

8. The music synthesizer of dynamic channel allocation as claimed in claim 6, wherein the source is a musical instrument digital interface player (MIDI player).

9. The music synthesizer of dynamic channel allocation as claimed in claim 6, wherein the assignation module executes the assignation according to predetermined priority of the audio instruction.

10. The music synthesizer of dynamic channel allocation as claimed in claim 6, wherein the search module further allocates unused memory space as an available channel.

11. A music synthesis system, comprising a synthesizer, allocating channels thereof to at least one audio instruction, wherein each audio instruction corresponds to a channel, wherein each audio instruction has an audio instruction ID, and each channel has an channel ID, and the audio instruction ID and the assigned channel ID have no intrinsic correspondence, wherein the channels are assigned to the audio instructions dynamically;

wherein the synthesizer further determines the type of each of the audio instructions;

wherein the synthesizer further sets a channel as a percussion instrument channel if the audio instruction is determined to be a percussion type audio instruction, and sets a channel as a melody instrument channel if the audio instruction is determined to be a melody type audio instruction.

12. The music synthesis system as claimed in claim 11, wherein the audio instructions are received from at least one musical instrument digital interface player (MIDI player).

13. The music synthesis system as claimed in claim 11, wherein the synthesizer executes the allocation according to predetermined priority of the audio instruction.

14. The music synthesis system as claimed in claim 11, wherein the synthesizer further allocates unused memory space as an available channel.

* * * * *